US006886429B1

(12) United States Patent
Lee

(10) Patent No.: US 6,886,429 B1
(45) Date of Patent: May 3, 2005

(54) RATCHET WRENCH HAVING A PIVOTAL HEAD

(76) Inventor: Chang-Chuan Lee, No. 429, Zhong Zheng Rd., Cao Tun Zhen, Nan Tou Hsien (TW)

( * ) Notice: Subject to any disclaimer, the term of this patent is extended or adjusted under 35 U.S.C. 154(b) by 0 days.

(21) Appl. No.: 10/791,444

(22) Filed: Mar. 1, 2004

(51) Int. Cl.[7] ..... B25B 23/16
(52) U.S. Cl. ..... 81/177.8; 81/177.7; 81/177.9
(58) Field of Search ..... 81/177.7, 177.8, 81/177.9

(56) References Cited

U.S. PATENT DOCUMENTS 2,028,561 A * 1/1936 Pilger ..... 81/177.9
6,000,302 A * 12/1999 Chiang ..... 81/177.8
6,216,567 B1 * 4/2001 Hu ..... 81/177.9
6,295,898 B1 * 10/2001 Hsieh ..... 81/177.8
6,386,075 B1 * 5/2002 Shiao ..... 81/177.8
6,745,650 B1 * 6/2004 Chang ..... 81/177.8

* cited by examiner

*Primary Examiner*—David B. Thomas
(74) *Attorney, Agent, or Firm*—Charles E. Baxley

(57) ABSTRACT

The present invention relates to a ratchet wrench having a pivotal head, which generally includes a handle, an elastic plate, an elastic block and a pivotal head. Wherein the handle is defined with a slot at an end thereof, the elastic block is defined at an end thereof with an engaging portion, and at another end thereof is formed with a notch for the reception of the elastic plate. With the help of the elastic plate, the elastic block is movably received in the slot of the handle of the ratchet wrench. At end of the pivotal head is formed with a coupling portion which is to be received in the slot of the handle, so as to engage with the engaging portion of the elastic block. By such arrangements, the ratchet head of the wrench can change the operational angle relative to the handle, so as to improve the applicability of the ratchet wrench.

5 Claims, 5 Drawing Sheets

RATCHET WRENCH HAVING A PIVOTAL HEAD

BACKGROUND OF THE INVENTION

1. Field of the Invention

The present invention relates to a ratchet wrench, and more particularly to a ratchet wrench that has a pivotal head.

2. Description of the Prior Arts

A conventional ratchet wrench, at an end of which is generally provided with a ratchet wheel, a locking block and an elastic element, the ratchet wrench is processed with a capability of changing rotation direction during operation, and thus it is more convenient for the ratchet wrench to screw the object to be operated. However, since the ratchet wheel, the locking block and the elastic element are disposed at an end of the integral-formed ratchet wrench, a handle of the ratchet wrench is not foldable according to special needs, and as a result that an operational angle of the ratchet wrench is not adjustable either, therefore, the applicability of the conventional ratchet wrench is limited.

The present invention has arisen to mitigate and/or obviate the afore-described disadvantages of the conventional ratchet wrench.

SUMMARY OF THE INVENTION

The primary object of the present invention is to provide a ratchet wrench having a pivotal head, wherein a ratchet head is coupled to a handle of the ratchet wrench in a manner that the operational angle of the ratchet head is adjustable, and thus the ratchet wrench in accordance with the present invention is improved in applicability.

In accordance with one aspect of the respect of the present invention, there is provided with a ratchet wrench having a pivotal head, which generally includes a handle, an elastic plate, an elastic block and a pivotal head. Wherein the handle is defined with a slot at an end thereof, the elastic block is defined at an end thereof with an engaging portion, and at another end thereof is formed with a notch for the reception of the elastic plate. With the help of the elastic plate, the elastic block is movably received in the slot of the handle of the ratchet wrench. At end of the pivotal head is formed with a coupling portion that is to be received in the slot of the handle, so as to engage with the engaging portion of the elastic block. By such arrangements, the ratchet head of the wrench can change the operational angle relative to the handle, so as to improve the applicability of the ratchet wrench.

The present invention will become more obvious from the following description when taken in connection with the accompanying drawings, which shows, for purpose of illustrations only, the preferred embodiment in accordance with the present invention.

DETAILED DESCRIPTION OF THE PREFERRED EMBODIMENT

Figure 1:
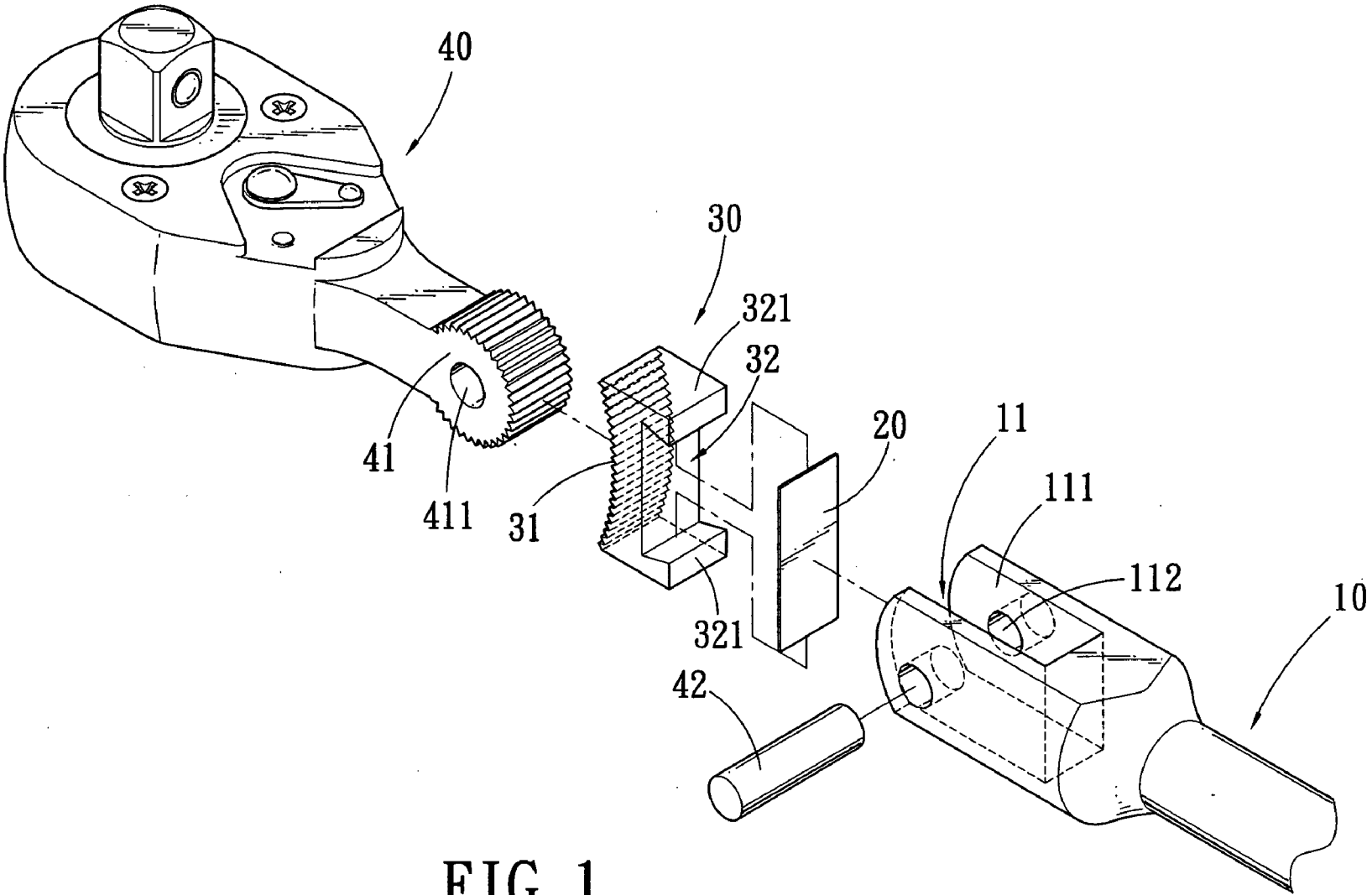
FIG. 1 is an exploded view of a ratchet wrench in accordance with the present invention.
Figure 2:
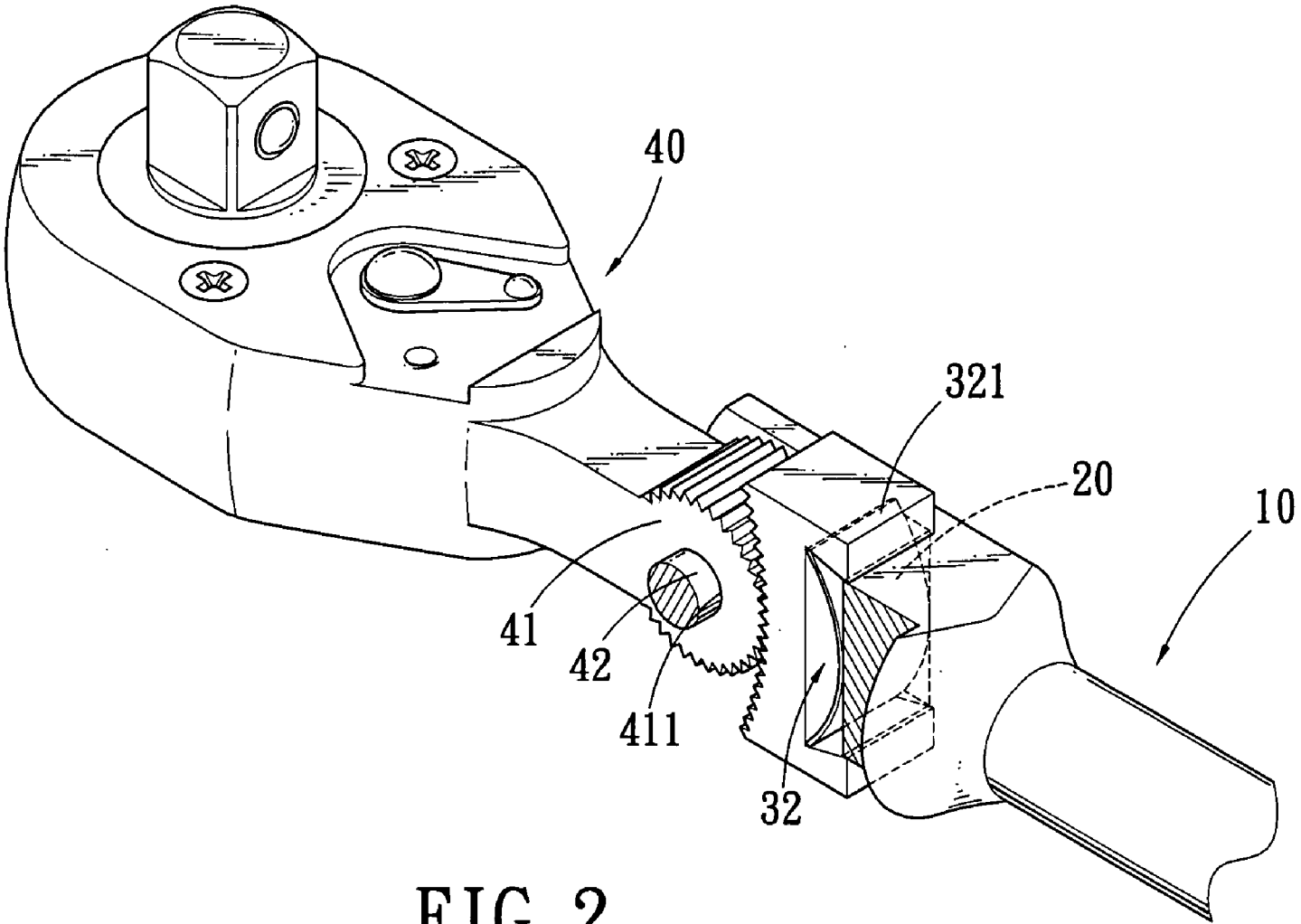
FIG. 2 is an assembly view of the ratchet wrench in accordance with the present invention.
Figure 3:
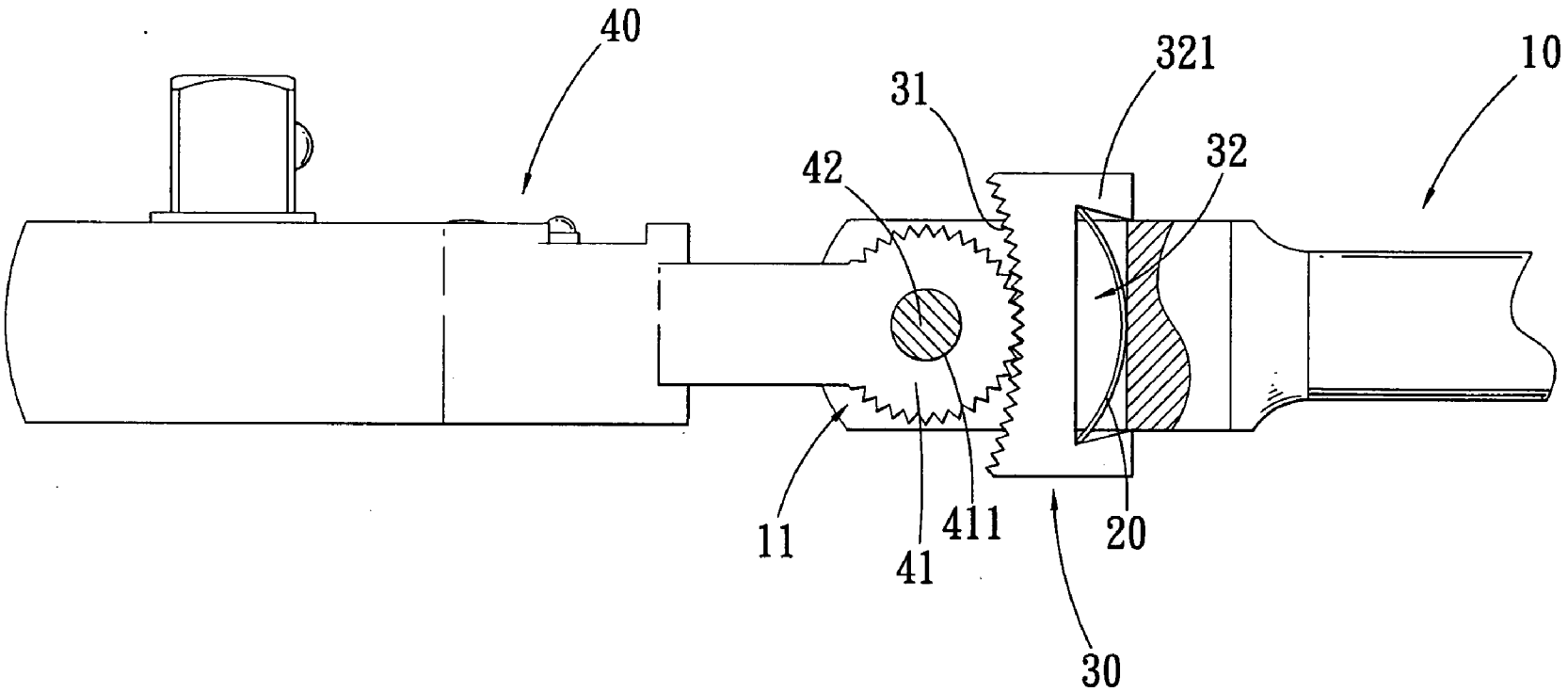
FIG. 3 is a cross sectional view of the ratchet wrench in accordance with the present invention.

Referring to FIGS. 1–3, wherein a ratchet wrench having a pivotal head in accordance with a preferred embodiment of the present invention is shown and generally comprising a handle 10, an elastic plate 20, an elastic block 30 and a ratchet head 40.

The handle 10 is provided at a first end thereof with a 'U'-shaped slot 11, on both opposite sides 111 of the slot 11 a through hole 112 is defined, whereas a second end of the handle 10 is provided for a user's grip.

The elastic plate 20 is a bendable piece to be received in the slot 11 of the handle 10.

The elastic block 30 is provided at a first end thereof with an engaging portion 31 with threads, whereas at a second end of the elastic block 30 is defined with a 'U'-shaped notch 32. Wherein width of a mouth of the notch 32 is minor than that of a bottom of the notch 32, such that internal surface of sidewall 321 of the notch 32 is inclined. The elastic plate 20 engages in the notch 32 with both ends abutting against a bottom thereof in a manner that the elastic plate 20 is arc-formed. With the help of the elastic plate 20, the elastic block 30 is movably disposed in the slot 11 of the handle 10 in a manner that the sidewall 321 of the notch 32 protrudes out of both sides of a bottom of the slot 11.

The ratchet head 40 is rotatable, at a first end of which is defined with a coupling portion 41 which is formed with through hole 411, at an outer periphery of the ratchet head 40 is formed with threads. The ratchet head 40 is engaged in the slot 11 of the handle 10 with a pin 42 inserting through the hole 411 and the hole 112 of the handle 10, so as to engage with the engaging portion 31 of the elastic block 30.

Figure 4:
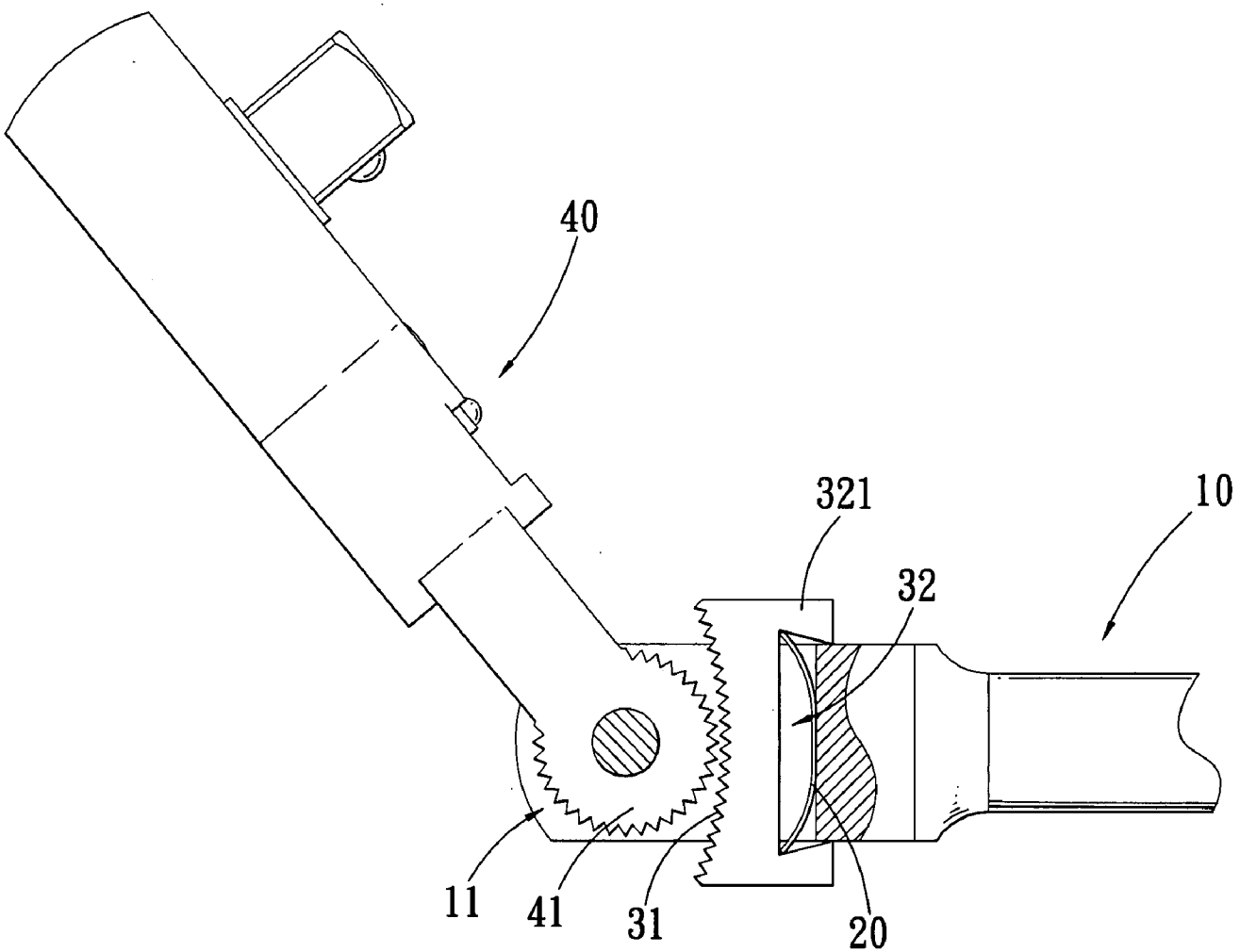
FIG. 4 is an operational view of the ratchet wrench in accordance with the present invention.
Figure 5:
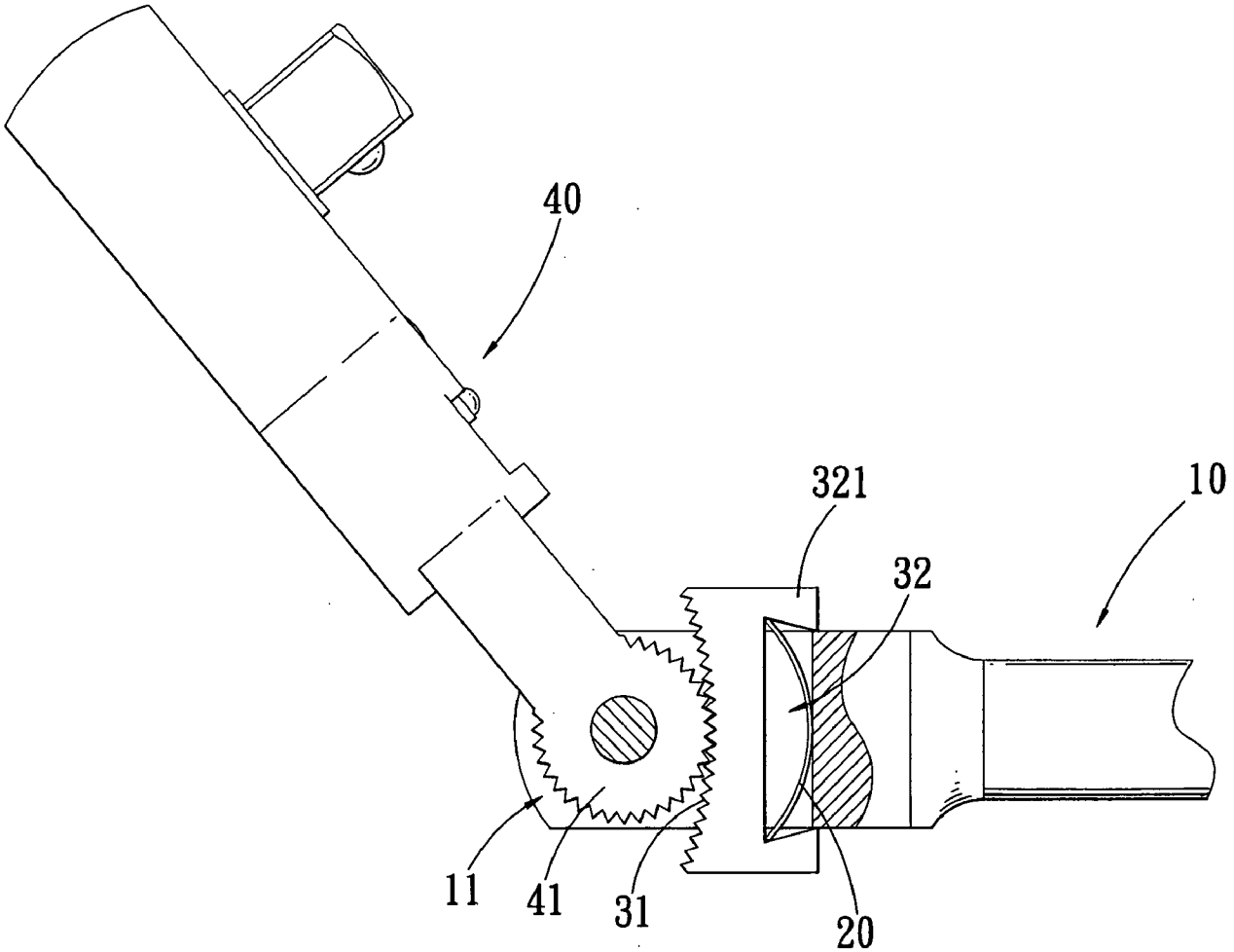
FIG. 5 is another operational view of the ratchet wrench in accordance with the present invention.

Referring to FIGS. 3–5, initially the user can press the elastic block 30 on the outer periphery of the sidewall 321 to push it toward the bottom of the slot 11 of the handle 10, so as to make the engaging portion 31 of the elastic block 30 disengage from the coupling portion 41 of the ratchet head 40. In the meantime, the elastic block 30 is pressing against the elastic plate 20 to make it a little deformed, such that the user is able to adjust the ratchet head 40 to a desired angle. After adjustment, the user can release the elastic block 30, such that the elastic block 30 is driven back to its original position by the elastic plate 20, and thus the engaging portion 31 of the elastic block 30 will engage with the coupling portion 41 of the ratchet head 40 again.

While we have shown and described various embodiments in accordance with the present invention, it should be clear to those skilled in the art that further embodiments may be made without departing from the scope of the present invention.

What is claimed is:

1. A ratchet wrench having a pivotal head comprising:

a handle provided at a first end thereof with a slot;

an elastic plate employed to be received in the slot of the handle;

an elastic block provided at a first end thereof with an engaging portion, and at a second end thereof defined with a notch for the reception of the elastic plate, with help of the elastic plate, the elastic block movably disposed in the slot of the handle;

a ratchet head, at a first end of which is defined with a coupling portion, the coupling portion being received in the slot of the handle, so as to engage with the engaging portion of the elastic block.

2. The ratchet wrench having a pivotal head as claimed in claim 1, wherein the slot of the handle is 'U'-shaped.

3. The ratchet wrench having a pivotal head as claimed in claim 1, wherein a through hole is formed on both opposite sides of the slot respectively, and on the coupling portion of the ratchet head is also defined with a through hole, such that the ratchet head can be rotatably received in the slot of the handle with a pin inserting through the through holes of the handle and the coupling portion of the ratchet head.

4. The ratchet wrench having a pivotal head as claimed in claim 1, wherein the engaging portion of the elastic block is formed with threads, and the coupling portion of the ratchet head is also provided at an outer periphery thereof with threads.

5. The ratchet wrench having a pivotal head as claimed in claim 1, wherein a width of a mouth of the notch is minor than that of a bottom of the notch.

* * * * *